US009097487B2

(12) United States Patent
Kempf

(10) Patent No.: US 9,097,487 B2
(45) Date of Patent: Aug. 4, 2015

(54) STRING SUPPRESSOR FOR ARCHERY BOWS

(71) Applicant: James Jay Kempf, Coralville, IA (US)

(72) Inventor: James Jay Kempf, Coralville, IA (US)

( * ) Notice: Subject to any disclaimer, the term of this patent is extended or adjusted under 35 U.S.C. 154(b) by 201 days.

(21) Appl. No.: 13/987,212

(22) Filed: Jul. 11, 2013

(65) Prior Publication Data

US 2015/0013657 A1 Jan. 15, 2015

(51) Int. Cl.
*F41B 5/20* (2006.01)
*F41B 5/14* (2006.01)

(52) U.S. Cl.
CPC ..... *F41B 5/1407* (2013.01); *F41B 5/1426* (2013.01)

(58) Field of Classification Search
CPC ..... F41B 5/1426; F41B 5/1407
USPC ..... 124/89, 88, 86, 23.1, 25.6, 90–92
See application file for complete search history.

(56) References Cited

U.S. PATENT DOCUMENTS 5,390,656 A * 2/1995 Villa et al. ..... 124/89
5,720,269 A * 2/1998 Saunders ..... 124/86
6,499,478 B1 * 12/2002 Perez ..... 124/86
6,889,679 B2 * 5/2005 Chattin ..... 124/25.6
7,793,646 B2 * 9/2010 Cooper et al. ..... 124/89
7,954,481 B2 * 6/2011 Barnard ..... 124/88
8,011,356 B2 * 9/2011 Gordon et al. ..... 124/88
8,365,713 B2 * 2/2013 Grace, Jr. ..... 124/89
8,978,636 B2 * 3/2015 Bednar et al. ..... 124/89
2008/0264400 A1 * 10/2008 Wright ..... 124/89
2010/0170488 A1 * 7/2010 Rasor et al. ..... 124/25
2010/0192931 A1 * 8/2010 Brewster ..... 124/89

OTHER PUBLICATIONS

Hydroshock video @ www.youtube.com/watch?v=c5yrRvzL88I.

* cited by examiner

*Primary Examiner* — Joshua Kennedy
(74) *Attorney, Agent, or Firm* — Donald J. Ersler

(57) ABSTRACT

The spring suppressor preferably includes a housing, a piston rod, a compression spring and an end plug. The piston includes a bumper portion, a neck portion and a tail portion. The housing includes a bumper hole, a piston bore and a cap thread. The piston bore is formed through substantially a length of the housing. The bumper hole is sized to slidably receive an outer diameter of the bumper portion. The cap thread is formed in an entrance of the piston bore to threadably receive the end plug. The piston is pre-loaded by the compression spring. The end plug is threaded into an end of the piston bore to retain the compression spring and the piston rod. A second embodiment of the string suppressor preferably includes the bumper, the piston rod, the compression spring, a housing and an end rod.

4 Claims, 5 Drawing Sheets

STRING SUPPRESSOR FOR ARCHERY BOWS

FIELD OF THE INVENTION

The present invention relates generally to archery and more specifically to string suppressors, which suppress noise and vibration of a bow string of an archery bow, such as a crossbow.

DISCUSSION OF THE PRIOR ART

Historically, archery bows and crossbows have been used for recreation, war and survival. Whether a recurve bow, compound, recurve crossbow, or compound crossbow, an archery bow utilizes a bowstring to propel an arrow. Upon the release of an arrow, the bowstring of the archery bow creates a great deal of vibration, noise, and resonance, all of which are negative attributes. Several years ago, solid rubber bumpers, or "stops" were placed in the path of the bowstring as shown in U.S. Pat. No. 7,954,481 to Barnard, in an effort to stop some of these negative attributes. Though only marginally successful, these solid stops did help dampen some of the string vibration. More recently, efforts have been made to absorb more of the noise, shock, and vibration of the bowstring by use of miniature shock absorbers, such as those disclosed by the Hydroshock product, shown in youtube video at http://www.youtube.com/watch?v=c5yrRvzL88I, or by utilizing a combination of a spring and rubber balls, as disclosed in U.S. Pat. No. 8,365,713 to Grace, Jr.

Although the previously disclosed devices work to a certain extent, there is still a need for a less expensive, better functioning string suppressor. The prior art discloses placing a rubber stop portion of the string suppressor flush with the forward edge of the bow string, when the bow string is at rest. Upon shooting the bow, the string travels towards the suppressor at a great speed, striking the rubber portion, rebounding the opposite direction, traveling forward again, repeating this sequence many times before the bowstring comes to a rest.

Accordingly, there is a clearly felt need in the art for a string suppressor for archery bows, which suppresses noise and vibration of a bowstring of an archery bow, such as a crossbow and which is less expensive than that of the prior art.

SUMMARY OF THE INVENTION

A string suppressor for an archer bow (spring suppressor) includes a minimal number of components, and is adjustably mounted to function as a string stop and/or a string vibration suppressor. The spring suppressor preferably includes a bumper, a piston rod, a housing, a compression spring and an end plug. The bumper is preferably fabricated from a durable rubber. The piston includes a bumper portion, a neck portion and a tail portion. The bumper portion extends from one side of the neck portion and the tail portion extends from an opposing side of the neck portion. The bumper is attached to the bumper portion. The housing includes a piston portion and a mounting portion. The mounting portion extends from a bottom of the piston portion. A bumper hole, a piston bore and a cap thread are formed in the piston portion. The piston bore is formed through substantially a length of the piston portion. The bumper hole is formed through an end of the piston bore. The bumper hole is sized to slidably receive an outer diameter of the bumper portion. The cap thread is formed in an entrance of the piston bore to threadably receive the end plug.

The piston bore is sized to slidably receive an outer diameter of the neck portion. An outer diameter of the tail portion is sized to receive an inner diameter of the compression spring and an outer diameter of the compression spring is sized to be received by the piston bore. The end plug is threaded into an end of the piston bore to retain the compression spring and the piston rod. The end plug includes a tail hole, which is sized to receive the tail portion. The spring suppressor is mounted on the shooting bow with the spring pre-loaded to apply pressure to the bowstring.

A second embodiment of the string suppressor preferably includes the bumper, the piston rod, a housing, the compression spring and an end rod. The end rod includes a first threaded end, a rod body and a second threaded end. The first threaded end is formed on a first end of the rod body and the second threaded end is formed on a second end of the rod body.

Accordingly, it is an object of the present invention to provide a shooting bow that is compact, light-weight, versatile, and adjustable.

Finally it is another object of the present invention to provide a string suppressor that pre-loads the bowstring, as to greatly reduce oscillation of the bowstring.

DETAILED DESCRIPTION OF THE PREFERRED EMBODIMENTS

Figure 1:
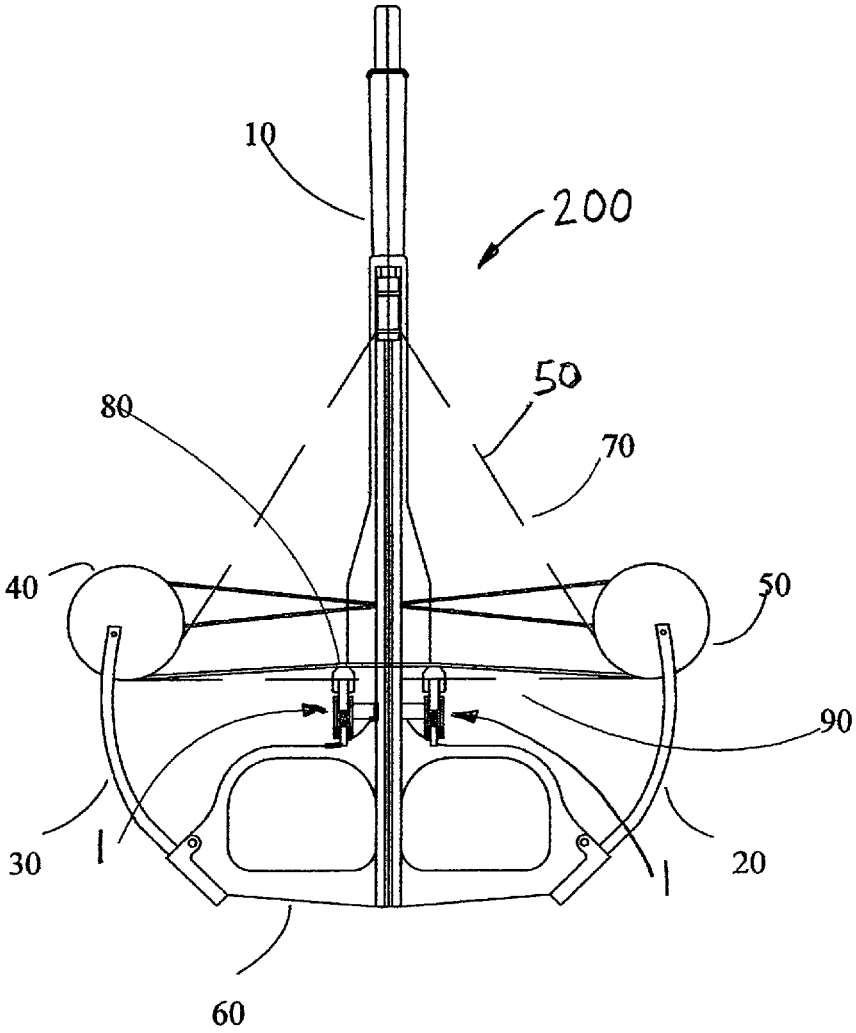
FIG. 1 is a top view of a crossbow with two string suppressors positioned to pre-load a bowstring in accordance with the present invention.
Figure 3:
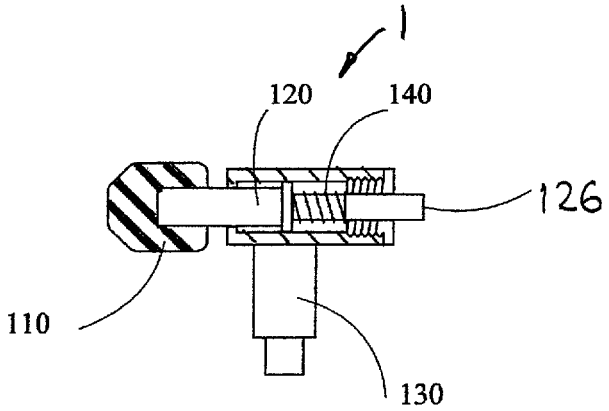
FIG. 3 is a side cross sectional view of a string suppressor in a pre-loaded position in accordance with the present invention.

Referring to FIG. 1, two string suppressors 100 are affixed to a shooting crossbow 10. More specifically, FIG. 1 shows the bowstring 50 of the shooting crossbow 10 in three positions. A first position 70 shows a cocked bowstring 50; a second position 80 shows an un-cocked bowstring 50 with preload; and a third position 90 shows an un-cocked bowstring 50 without preload. The string suppressors 100 may be affixed to the shooting bow 10 so that there is no bowstring preload. However for best results, it is preferable to position the string suppressors 100, such that there is at least some preload on the bowstring 50. With reference to FIG. 3, the string suppressor 100 includes some preload, which corresponds to the un-cocked bowstring 50 in the second position 80 in FIG. 1.

Figure 2:
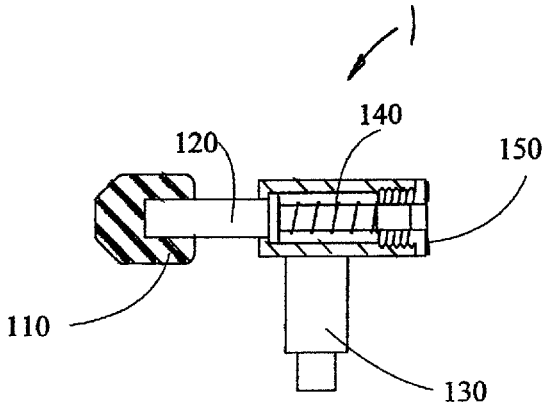
FIG. 2 is a side cross sectional view of a string suppressor in a rest position in accordance with the present invention.
Figure 5:
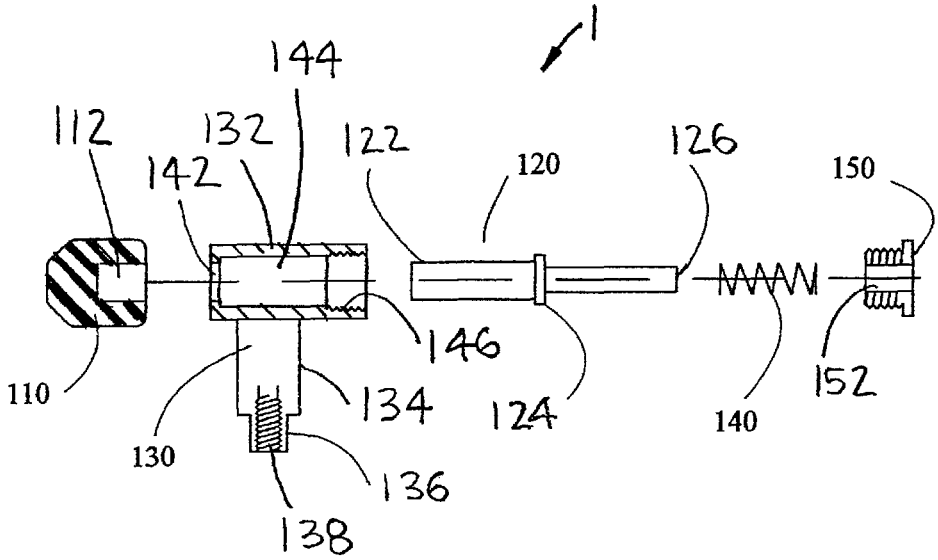
FIG. 5 is an exploded cross section view of a string suppressor in accordance with the present invention.

Referring to FIGS. 2, 3 and 5, the first embodiment spring suppressor 100 preferably includes a bumper 110, a piston rod 120, a housing 130, a compression spring 140 and an end plug 150. The bumper 110 is preferably fabricated from a durable rubber material. The piston rod 120 includes a bumper portion 200, a neck portion 220 and a tail portion 210. The bumper portion 200 extends from one side of the neck portion 220 and the tail portion 210 extends from an opposing side of the neck portion 220. The bumper includes a rod hole 112. The bumper 110 is attached to an end of the bumper portion 200 by friction or with any suitable attachment method. The housing 130 includes a piston portion 132 and a mounting portion 134. The mounting portion 134 extends from a bottom of the piston portion 132. A mounting boss 180 preferably extends from a bottom of the mounting portion 134. A threaded tap 138 is formed in an end of the mounting boss 180 to threadably engage a threaded fastener (not shown). At least one hole is formed in the shooting crossbow 10 to receive the mounting boss 180 of the string suppressor 100. The string suppressor 100 is preferably retained in the shooting crossbow 10 with a threaded fastener (not shown).

A bumper hole 142, a piston bore 144 and an end plug thread 146 are formed in the piston portion 132. The piston bore 144 is formed through substantially a length of the piston portion 132. The bumper hole 142 is formed through an end of the piston bore 144. The bumper hole 142 is sized to slidably receive an outer diameter of the bumper portion 122. The end plug thread 146 is formed in an entrance of the piston bore 144 to threadably receive the end plug 150. The piston bore 144 is sized to slidably receive an outer diameter of the neck portion 220. The piston rod 120 is pre-loaded by the compression spring 140. An outer diameter of the tail portion 210 is sized to receive an inner diameter of the compression spring 140 and an outer diameter of the compression spring 140 is sized to be received by the piston bore 144. The end plug 150 includes a tail hole 152 to slidably receive the tail portion 210. The end plug 150 is threaded into the end plug thread 146 to retain the compression spring 140 and the piston rod 120.

FIG. 3 shows the string suppressor 100 in a preloaded position, wherein the bowstring 50 applies pressure to the bumper 110 forcing the tail portion 210 out of the housing 130 and partially compressing the spring 140. When the bowstring 50 is moved into the first position 70, the spring 140 forces the piston rod 120 to the fully extended position as shown in FIG. 2. When the bowstring 50 is in position 80, the bumper 110 forces the bowstring 50 rearward. When the bowstring 50 is released from the first position 70, the bowstring 50 travels forward at great speed, striking the bumpers 110, forcing the bumpers 110 and piston rods 120 to compress the compression spring 140 within the housing 130.

When the compression spring 140 is fully compressed, there is stored energy therein. When the compression spring 140 is uncompressed, the stored energy therein is released, which forces the piston rod 120 and the bumper 110 in the opposite direction. If the bowstring 50 is in contact with the bumper 110, the bowstring will also travel in the opposite direction.

The movement of the piston rod 110 in a first direction and again in an opposite direction creates a "cycle". The piston rod 120 and bumper 110 travel the greatest distance during a first cycle, and during multiple subsequent cycles, the piston rod 120 and the bumper 110 travel less distance with each progressive cycle until the piston rod 120 and the bumper 110 come to a complete stop.

Figure 4:
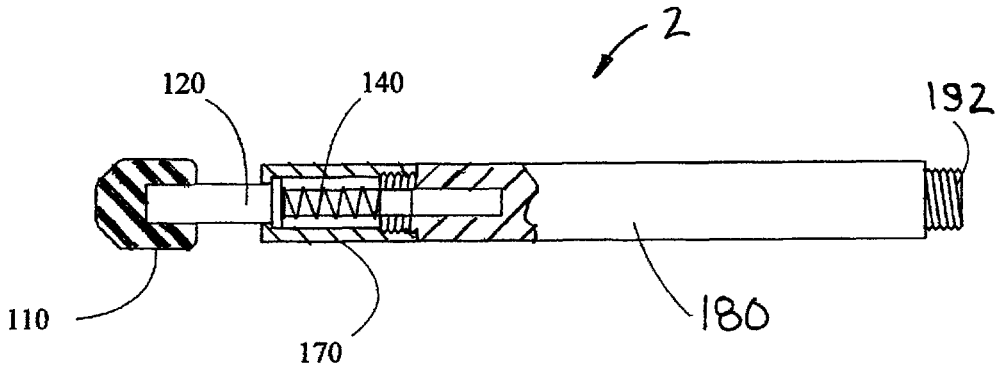
FIG. 4 is a partial side cross sectional view of a second embodiment of the string suppressor in accordance with the present invention.
Figure 6:
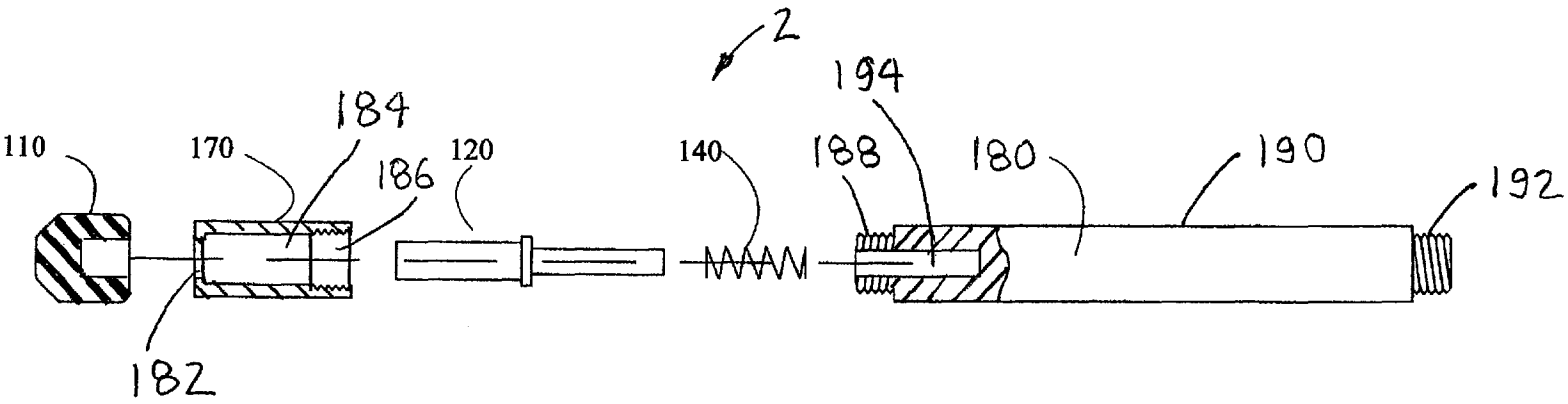
FIG. 6 is an exploded cross section view of a second embodiment of the string suppressor in accordance with the present invention.

With reference to FIGS. 4 and 6, a second embodiment of the string suppressor 200 preferably includes the bumper 110, the piston rod 120, the compression spring 140, a housing 170 and an end rod 160. The housing 170 includes a bumper hole 182, a piston bore 184 and an end rod thread 186. The piston bore 184 is formed through substantially a length of the housing 170. The bumper hole 182 is formed through an end of the piston bore 184. The bumper hole 182 is sized to slidably receive an outer diameter of the bumper portion 122. The end rod thread 186 is formed in an entrance of the piston bore 184 to threadably receive the end rod 160. The piston bore 184 is sized to slidably receive an outer diameter of the neck portion 220. The piston rod 120 is pre-loaded by the compression spring 140. An outer diameter of the tail portion 210 is sized to receive an inner diameter of the compression spring 140 and an outer diameter of the compression spring 140 is sized to be received by the piston bore 184.

The end rod 160 includes a first threaded end 188, a rod body 190 and a second threaded end 192. A tail bore 194 is formed in the first threaded end 188 to slidably receive the tail portion 210. The first threaded end 188 is formed on a first end of the rod body 190 and the second threaded end 192 is formed on a second end of the rod body 190. The end rod thread 186 is sized to threadably receive the first threaded end 188 and retain the piston rod 120 and the compression spring 140. The second threaded end 192 may be threaded into the shooting crossbow 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A string suppressor for attachment to an archery bow, comprising:

a housing includes a bumper hole and a piston bore, said piston bore is formed through substantially all of a length of said housing, said bumper hole is formed through an end of said piston bore, an inner thread is formed in said piston bore at an entrance to said piston bore;

a piston rod includes a bumper portion, a neck portion and a tail portion, said bumper portion extends from one side of said neck portion and said tail portion extends from an opposing side of said neck portion, said bumper portion is inserted through said bumper hole;

a bumper is secured to said bumper portion;

a compression spring is inserted into said piston bore, an end of said compression spring contacts said neck portion; and an end plug includes a tail hole formed through a length thereof and an outer thread formed on a perimeter thereof, said tail hole provides clearance for said tail portion, said outer thread is threadably engaged with said inner thread to retain said spring in said housing, wherein said tail portion is capable of extending through said end plug.

2. The string suppressor for attachment to an archery bow of claim 1 wherein:

said bumper is fabricated from a durable rubber material.

3. A string suppressor for attachment to an archery bow, comprising:

a housing includes a piston portion and a mounting portion, said mounting portion extends perpendicular from said piston portion, said piston portion includes a bumper hole and a piston bore, said piston bore is formed through substantially all of a length of said piston portion, said bumper hole is formed through an end of said piston bore, an inner thread is formed in said piston bore at an entrance to said piston bore;

a piston rod includes a bumper portion, a neck portion and a tail portion, said bumper portion extends from one side of said neck portion and said tail portion extends from an opposing side of said neck portion, said bumper portion is inserted through said bumper hole;

a bumper is secured to said bumper portion;

a compression spring is inserted into said piston bore, an end of said spring contacts said neck portion; and an end plug includes a tail hole formed through a length thereof and an outer thread formed on a perimeter thereof, said tail hole provides clearance for said tail portion, said outer thread is threadably engaged with said inner thread to retain said spring in said housing, wherein said tail portion is capable of extending through said end plug.

4. The string suppressor for attachment to an archery bow of claim 3 wherein:

said bumper is fabricated from a durable rubber material.

* * * * *